US007487967B2

(12) United States Patent
Uchida

(10) Patent No.: US 7,487,967 B2
(45) Date of Patent: Feb. 10, 2009

(54) SHEET CONVEYING DEVICE AND IMAGE FORMING APPARATUS INCLUDING THE SAME

(75) Inventor: Kazuyuki Uchida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 474 days.

(21) Appl. No.: 11/009,132

(22) Filed: Dec. 13, 2004

(65) Prior Publication Data

US 2005/0189700 A1 Sep. 1, 2005

(30) Foreign Application Priority Data

Dec. 25, 2003 (JP) ..... 2003-429489

(51) Int. Cl.
*B65H 5/02* (2006.01)

(52) U.S. Cl. ..... 271/274; 271/273; 399/124

(58) Field of Classification Search ..... 271/264, 271/273, 274, 117, 118, 18.2; 399/124; 400/637.1; 74/354

See application file for complete search history.

(56) References Cited

U.S. PATENT DOCUMENTS

| | | | | |
|---|---|---|---|---|
| 3,661,383 | A * | 5/1972 | Morrison | 271/273 |
| 3,779,638 | A * | 12/1973 | Ravera et al. | 399/108 |
| 5,016,868 | A * | 5/1991 | Ohtsuka et al. | 271/273 |
| 6,267,373 | B1 * | 7/2001 | Takata | 271/274 |
| 6,536,762 | B1 * | 3/2003 | Sheng et al. | 271/273 |
| 7,080,836 | B2 * | 7/2006 | Hamada et al. | 271/274 |
| 7,168,701 | B2 * | 1/2007 | Isaka et al. | 271/273 |
| 2003/0085508 | A1 * | 5/2003 | Fukuchi | 271/121 |

FOREIGN PATENT DOCUMENTS

| | | | |
|---|---|---|---|
| JP | 04-007240 | | 1/1992 |
| JP | 06087250 | A * | 3/1994 |
| JP | 06-156798 | | 6/1994 |
| JP | 07-309462 | | 11/1995 |
| JP | 2001-088975 | | 4/2001 |

* cited by examiner

*Primary Examiner*—Patrick H Mackey
*Assistant Examiner*—Jeremy R Severson
(74) *Attorney, Agent, or Firm*—Oblon, Spivak, McClelland, Maier & Neustadt, P.C.

(57) ABSTRACT

A sheet conveying device for an image forming apparatus of the present invention includes a cover hinged to the casing of the apparatus and supporting a roller shaft on which a drive roller is mounted. A driven roller and a positioning section for positioning the drive roller are mounted on the casing. The cover is movable between a closed position where the drive roller is pressed against the driven roller and an open position where the former is released from the latter. A first drive gear is affixed to the end of the roller shaft while a second drive gear, meshing with the first drive gear, is mounted on the cover and receives the output torque of a drive source. The roller shaft is mounted on the cover such that the pitch circle of the first drive gear moves on the pitch circle of the second drive gear while touching it externally.

12 Claims, 7 Drawing Sheets

SHEET CONVEYING DEVICE AND IMAGE FORMING APPARATUS INCLUDING THE SAME

BACKGROUND OF THE INVENTION

1. Field of the Invention

The present invention relates to a sheet conveying device including a drive roller caused to rotate about its own axis and a driven roller having an axis parallel to the axis of the drive roller and causing the two rollers to nip and convey a sheet and an image forming apparatus including the same.

2. Description of the Background Art

It is a common practice with a sheet conveying device included in a copier, printer, facsimile apparatus or similar image forming apparatus to cause a drive roller and a driven roller whose axes are parallel to each other to nip and convey a sheet in pressing contact with each other.

A sheet conveying device of the type including a drive roller and a driven roller movable away from each other to allow a sheet, jamming a sheet path, to be removed is conventional. More specifically, this type of sheet conveying device includes a front cover hinged to the casing of an image forming apparatus in such a manner as to be angularly movable about a shaft between an open position for uncovering the casing and a closed position for covering it. The driver roller and driven roller are mounted on the front cover and the casing of the image forming apparatus, respectively, and constitute an outlet roller pair for discharging a sheet brought thereto from a sheet cassette via a sheet path to a tray.

In the sheet conveying device having the above configuration, assume that a dimensional error occurs in the distance between the shaft of the front cover and the drive roller. Then, it is likely that when the front cover is moved to the closed position, the drive roller and driven roller fail to contact each other or excessively strongly contact each other, causing a roller shaft supporting the drive roller to bend. To prevent the roller shaft from rotating in a bent position, there must be enhanced the dimensional accuracy of the front cover, e.g., dimensional accuracy between the shaft of the front cover and the drive roller and the positional accuracy of the roller shaft of the drive roller, noticeably increasing costs.

SUMMARY OF THE INVENTION

It is an object of the present invention to provide a sheet conveying device capable of reducing, even when a dimensional error exists in a front cover supporting a drive roller, the bend of the roller shaft of the drive roller when the drive roller is pressed by a driven roller and thereby allowing the drive roller and driven roller to stably rotate and accurately convey a sheet without resorting to higher dimensional accuracy of the front cover and an image forming apparatus including the same.

A sheet conveying device for an image forming apparatus of the present invention includes a driven roller mounted on the casing of the apparatus and rotatable about its own axis. A cover supports a roller shaft on which a drive roller is mounted in such a manner as to be rotatable about its axis. The cover is hinged to the casing of the apparatus to be angularly movable between a closed position where the circumferential surface of the drive roller is pressed against the circumferential surface of the driven roller and an open position where the former is released from the latter. A positioning section is included in the casing and configured to support, when the cover is moved to the closed position, the roller shaft for thereby positioning the roller shaft. A first drive gear is affixed to the end of the roller shaft and rotatable integrally with the roller shaft. A second drive gear is held in mesh with the first drive gear and configured to receive a drive force from a drive source. The roller shaft is supported by the cover such that the pitch circle of the first drive gear moves on the pitch circle of the second drive gear while touching it externally.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
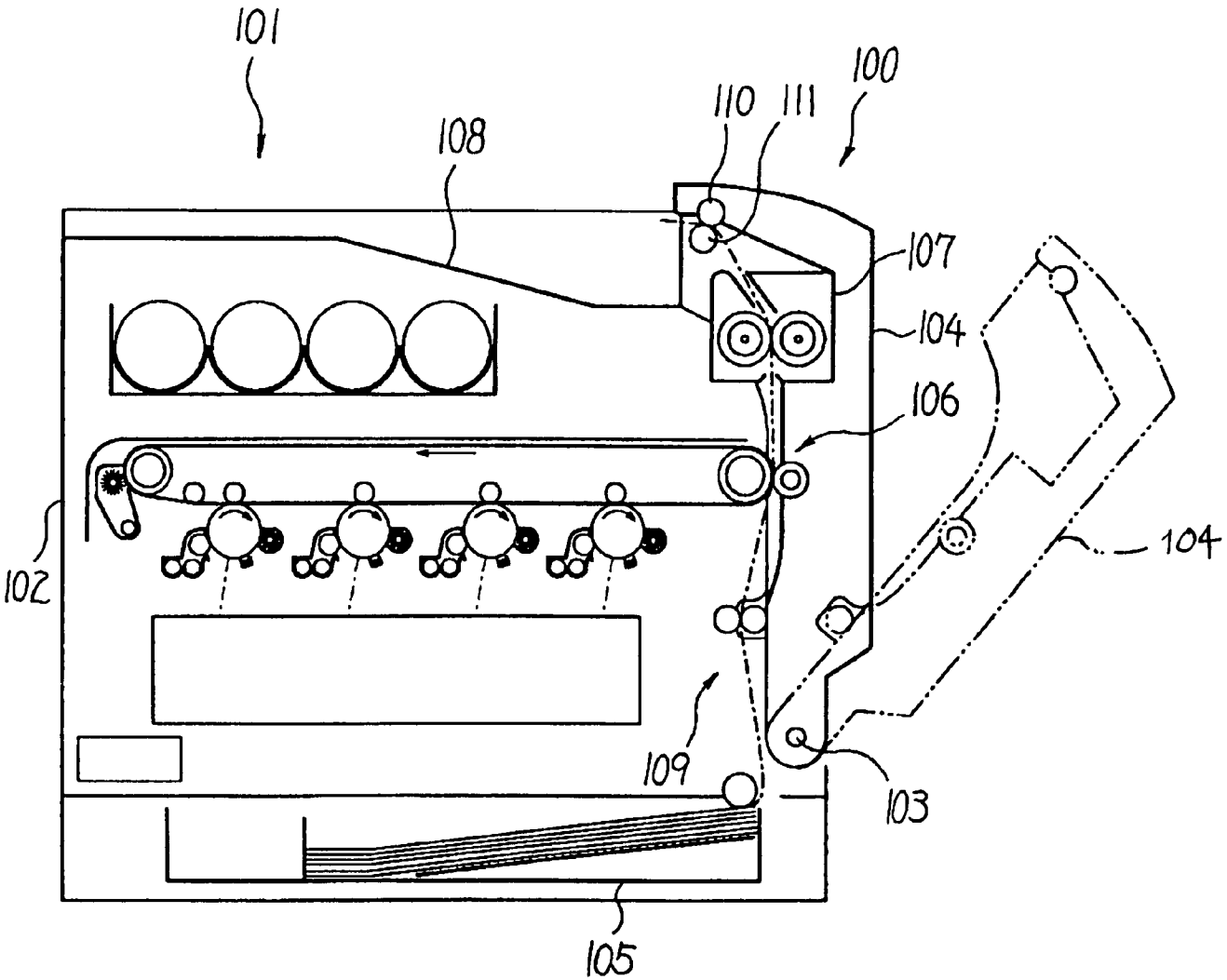
FIG. 1 PRIOR ART
FIG. 1 is a sectional side elevation showing a conventional color printer.

To better understand the present invention, brief reference will be made to a conventional color printer, shown in FIG. 1. As shown, the color printer, generally 101, includes a casing 102 and a sheet conveying device 100. The sheet conveying device 100 includes a front cover 104 hinged to the casing 102 by a shaft 103 such that the front cover 104 is angularly movable between a closed position and an open position indicated by a solid line and a phantom line, respectively.

The front cover 104 forms, when brought to the closed position, a sheet path 109 along which a sheet fed from a sheet cassette 105 is conveyed to a print tray 108 via an image transferring position 106 and a fixing position 107. When the sheet has jammed the sheet path 109, the front cover 104 is moved to the open position in order to uncover the sheet path 109 for thereby allowing the sheet to be removed by hand.

A plurality of roller pairs for conveying sheet are arranged on the sheet path 109, and each comprises a drive roller and a driven roller. Such rollers provided in pairs include a drive roller 110 and a driven roller 111 cooperating to convey the sheet brought thereto to the print tray 108.

Figure 2:
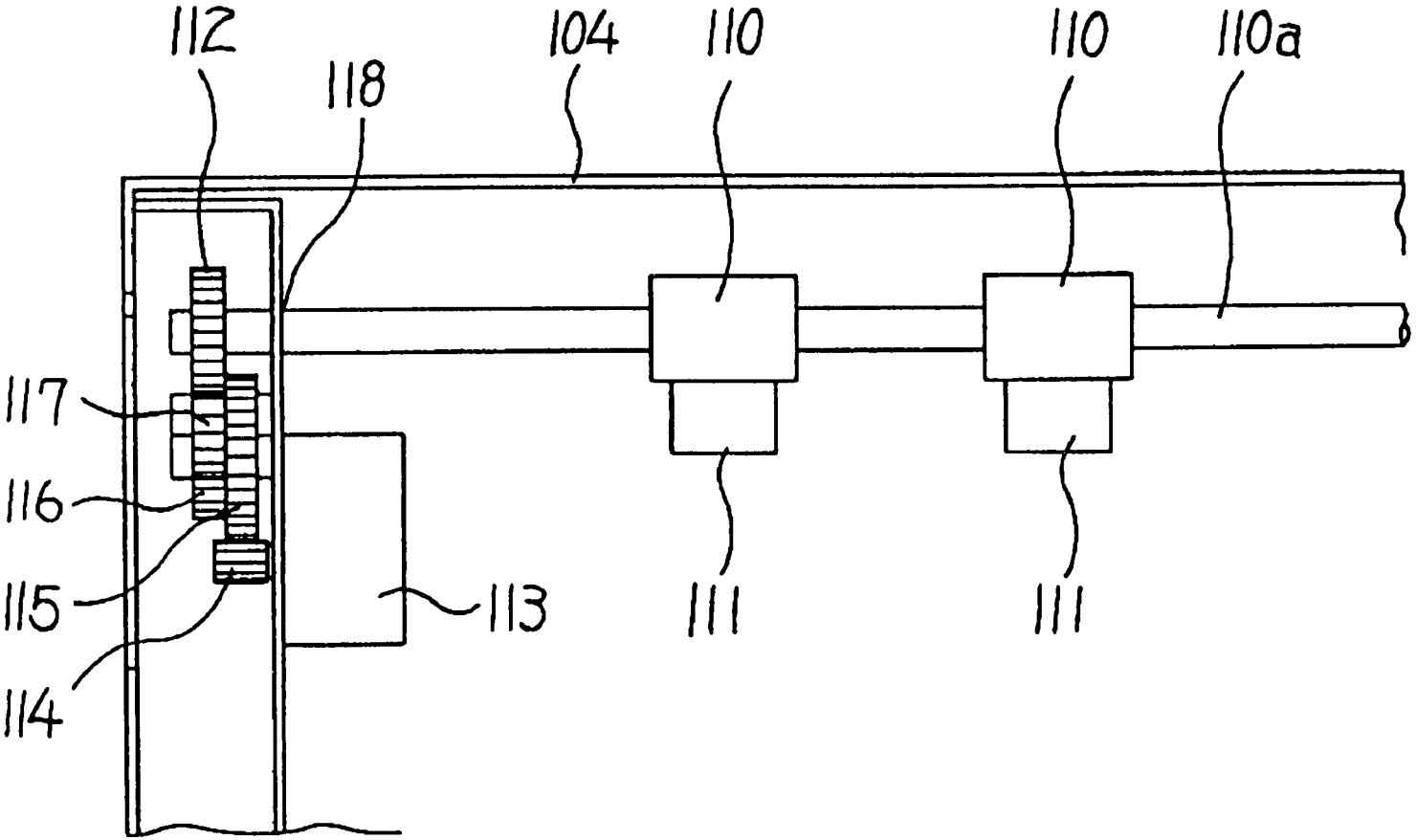
FIG. 2 PRIOR ART
FIG. 2 is a rear view showing a positional relation between drive rollers, driven rollers, a roller shaft and a positioning section in a condition wherein a front cover is moved to a closed position.

FIG. 2 shows the sheet conveying device 100 more specifically. As shown, the driven roller 111 is representative of a plurality of driven rollers 111 mounted on the casing 102 in such a manner as to be rotatable about a single axis. The driven roller 110 is also representative of a plurality of driven rollers 110 affixed to a rotatable roller shaft 110*a*, which is mounted on the front cover 104. A first gear 112 is affixed to one end of the roller shaft 110*a* and rotatable integrally with the roller shaft 110*a* and drive rollers 110. Also mounted on the front cover 104 are a drive motor 113 and a plurality of gears 114, 115, 116 and 117 for transmitting the output torque of the drive motor 113 to the first gear 112. The gear 117, held in mesh with the first gear 112, will be referred to as a second drive gear hereinafter.

Assume that a dimensional error occurs in the distance between the shaft 103 and the drive roller 110. Then, it is likely that when the front cover 104 is moved to the closed position shown in FIG. 1, the drive rollers 110 and driven rollers 111 fail to contact each other or excessively strongly contact each other. In light of this, a support member, not shown, may be mounted on the casing 102 in order to press the roller shaft 110*a* when the front cover 104 is moved to the closed position, thereby adequately correcting the distance between the drive rollers 110 and the driven rollers 111.

In operation, when the drive motor 113 on the front cover 104 is driven after the front cover 104 has been closed, the output torque of the drive motor 113 is transmitted to the roller shaft 110*a* via the gears 114, 115, 116, second drive gear 117 and first drive gear 112, causing the drive rollers 110 to rotate integrally with the roller shaft 110*a*. Consequently, the driven rollers 111 are caused to rotate by the drive rollers 110. In this condition, the drive rollers 110 and driven rollers 111 cooperate to drive a sheet being conveyed along the sheet path 109 to the print tray 108.

The support member mounted on the casing 102 as mentioned earlier brings about the following problem. Assume that the support member presses the roller shaft 110*a* when the front cover 104 is moved to the closed position, correcting the distance between the drive rollers 110 and the driven rollers 111. Then, the position of a support portion 118, supporting the roller shaft 110*a* on the front cover 104, and the position where the support member presses the roller shaft 110*a* do not align with each other, resulting in eccentricity. Such eccentricity causes the roller shaft 110*a* to bend between the support portion 118 and the position where the support member presses the roller shaft 110*a*.

If the roller shaft 110*a* thus bent between the above positions continuously rotates, then the roller shaft 110*a* and members supporting the roller shaft 110*a* and even the drive rollers 110 and driven rollers 111 are shaved off or worn out due to eccentricity. As a result, the rotation of the drive rollers 110 and driven rollers 111 becomes defective and causes consecutive sheets being conveyed to interfere with each other and jam the sheet path 109. Moreover, the durability of the drive rollers 110, roller shaft 110*a* and driven rollers 111 is lowered.

To prevent the roller shaft 110 from rotating in the bent position, there must be enhanced the dimensional accuracy of the front cover 104, e.g., dimensional accuracy between the shaft 103 and the drive rollers 110 and the positional accuracy of the support portion 118 supporting the roller shaft 110*a*, noticeably increasing costs.

Figure 3:
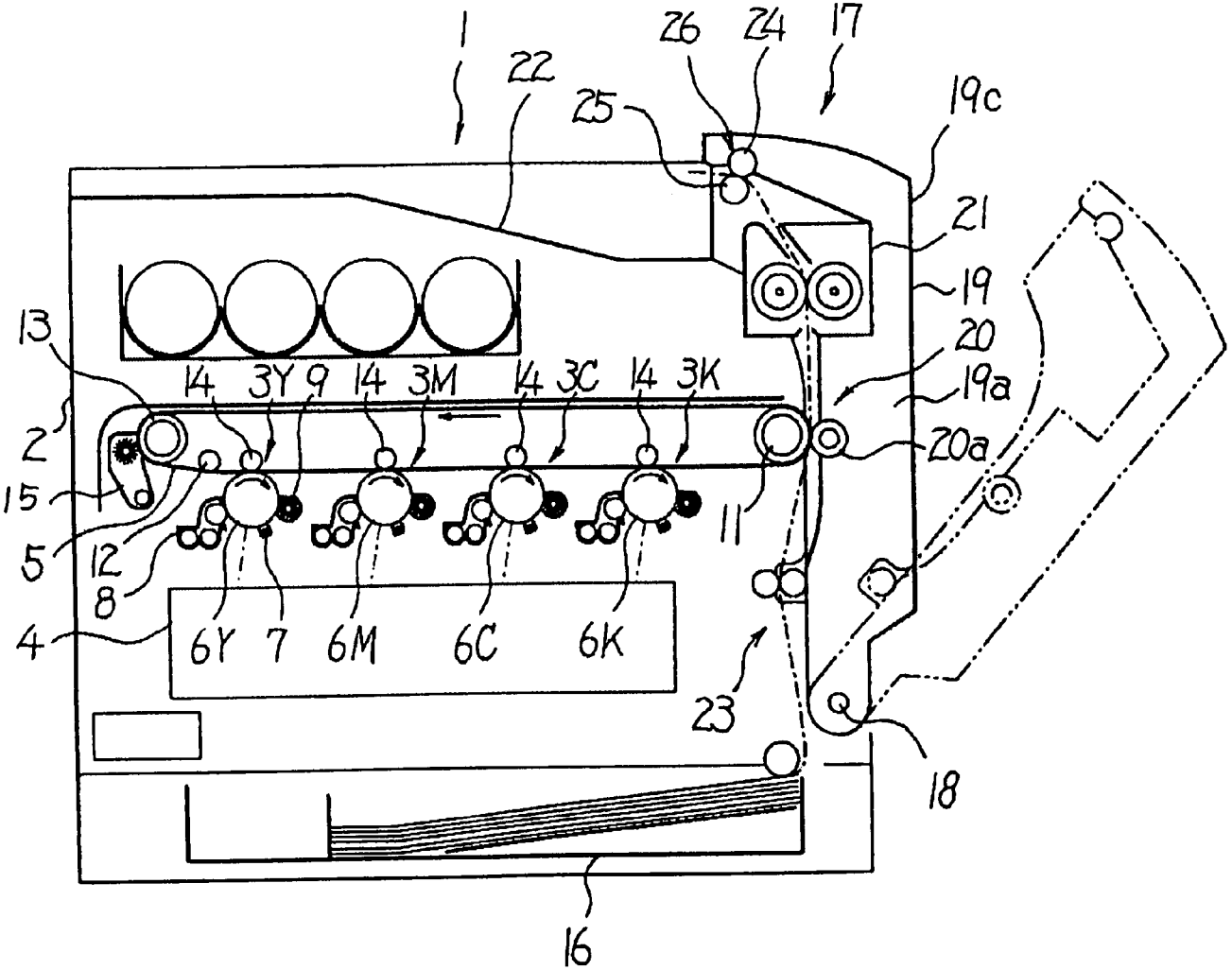
FIG. 3 is a sectional side elevation showing an image forming apparatus embodying the present invention.
Figure 4:
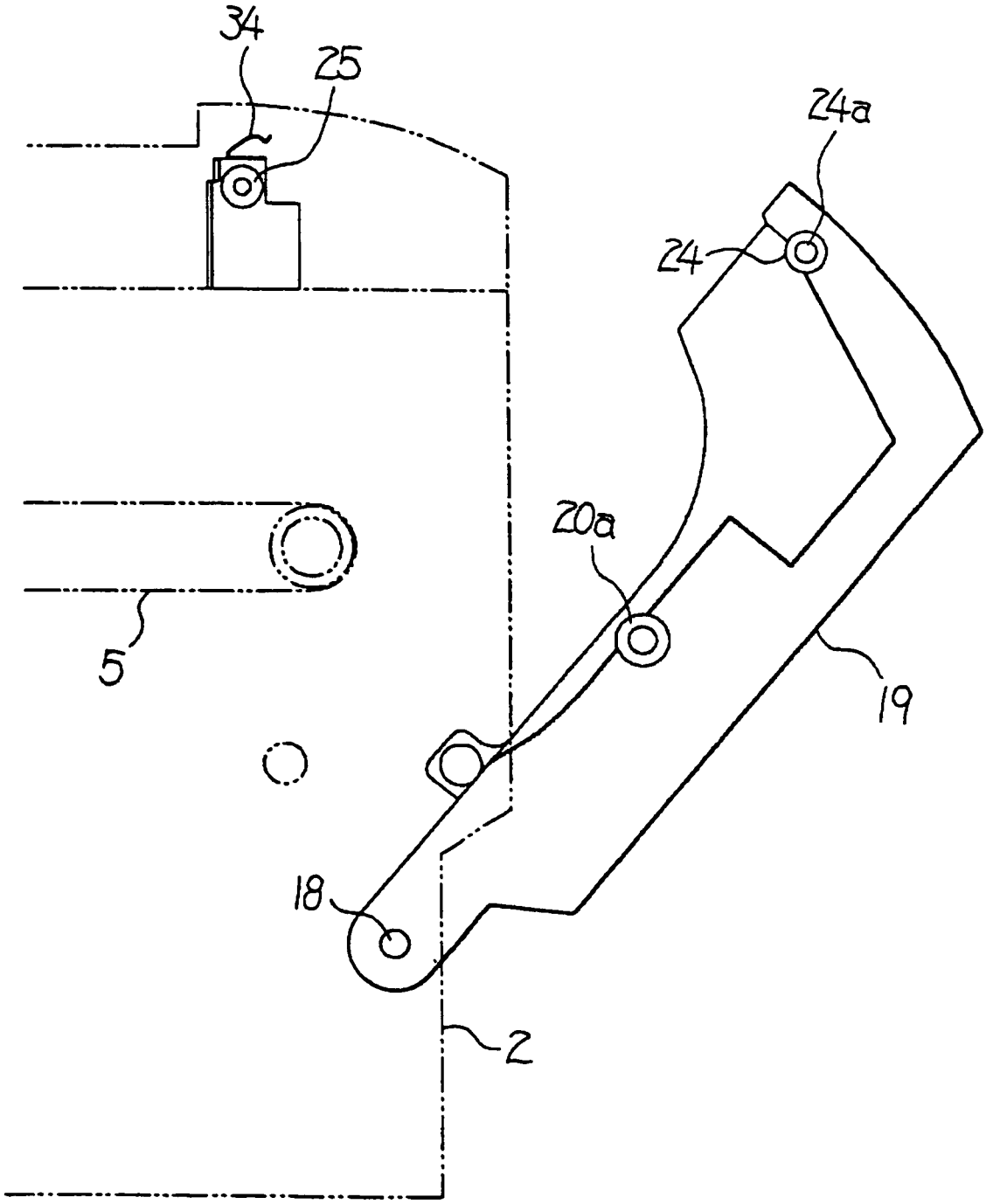
FIG. 4 is a side elevation showing a condition in which a front cover included in the illustrative embodiment is held in an open position.

Referring to FIG. 3, an image forming apparatus embodying the present invention is shown and implemented as an electrophotographic color printer by way of example. As shown, the color printer, generally 1, includes a casing 2 accommodating four image forming sections 3Y (yellow), 3C (cyan), 3M (magenta) and 3K (black), an optical writing unit 4, and an intermediate image transfer belt 5. The image forming sections 3Y through 3K each are configured to form a toner image in a particular color and will sometimes be collectively labeled 3 hereinafter. More specifically, the image forming sections 3Y through 3K are essentially identical in structure with each other except for the color of toner to use.

As shown in FIG. 3, each image forming sections 3 includes a photoconductive drum 6 (6Y, 6C, GM or 6K) rotatable in a direction indicated by an arrow and a charger 7, a developing unit 8 and a cleaning unit 9 arranged around the drum 6. It is to be noted that the photoconductive drum 6 is a specific form of an image carrier.

The drum 6, implemented as a hollow cylinder, is covered with a photoconductive layer and driven by a drive source not shown. A light beam, emitted from the optical writing unit 4, scans the surface of the drum 6 in the form of a spot, forming a latent image in accordance with image data.

The charger 7 uniformly charges the surface of the drum 6. In the illustrative embodiment, the charger 7 operates without contacting the drum 6. The developing unit 8 deposits toner on the latent image formed on the drum 6 for thereby producing a corresponding toner image. The developing unit 8 also operates without contacting the drum 6 in the illustrative embodiment. The cleaning unit 9 is configured to remove residual toner left on the drum 6. In the illustrative embodiment, the cleaning unit 9 includes a brush held in contact with the surface of the drum 6.

The intermediate image transfer belt (simply belt hereinafter) 5 is an endless or loop-like belt having a base implemented by a resin film or rubber. Toner images formed on the drums 6Y through 6K may be sequentially transferred to the belt 5 one above the other. The belt 5 is passed over rollers 11, 12 and 13 and caused to turn in a direction indicated by an arrow in FIG. 3. Four image transfer rollers 14 face the inner surface of the belt or loop 5 for transferring toner images from the drums 6Y through 6K to the belt 5. A belt cleaner 15 faces the outer surface or the belt or loop 5 for removing residual toner and impurities, including paper dust, deposited on the belt 5.

A sheet cassette 16 is positioned below the image forming sections 3Y through 3K and optical writing unit 4 and loaded with a stack of sheets. The sheets are sequentially paid out from the sheet cassette 16 one by one, the top sheet being first.

A sheet conveying device 17 unique to the illustrative embodiment is configured to convey the top sheet paid out from the sheet cassette 16 while separating it from the underlying sheets. The sheet conveying device 17 includes a front cover 19 hinged to the casing 2 of the color printer 1 by a shaft 18. The front cover 19 includes a pair of side walls 19*a* and 19*b* (only 19*a* is visible) respectively positioned at the front and rear sides and an end wall 19*c* connecting the side walls 19*a* and 19*b*. With this configuration, the front cover 19 is angularly movable about the shaft 18 between a closed position and an open position indicated by a solid line and a phantom line, respectively. The front cover 19 forms, when moved to the closed position, a sheet path 23 along which a sheet paid out from the sheet cassette 16 is conveyed to a print tray 22 via an image transferring section 20 and a fixing section 21.

The image transferring section 20 transfers a toner image from the belt 5 to the sheet being conveyed along the sheet path 23. More specifically, the image transferring section 20 includes an image transfer roller 20*a* for conveying the sheet in cooperation with the belt 5. The fixing section 21 fixes the toner image thus transferred to the sheet with heat and pressure. The sheet, coming out of the fixing section 21, is further conveyed to the print tray 22 by an outlet roller pair 26.

The sheet conveying device 17, characterizing the illustrative embodiment, will be described more specifically hereinafter. The front cover 19 is angularly movable about the shaft 18 between the closed position and the open position, as stated previously. The outlet roller pair 26, positioned at the outlet of the sheet path 23, is made up of a drive roller 24 mounted on the front cover 19 and a driven roller 25 mounted on the casing 2. When the front cover 19 is angularly moved to the closed position indicated by the solid line in FIG. 3, the circumferential surface of the drive roller 24 is pressed against the circumferential surface of the driven roller 25.

Figure 6:
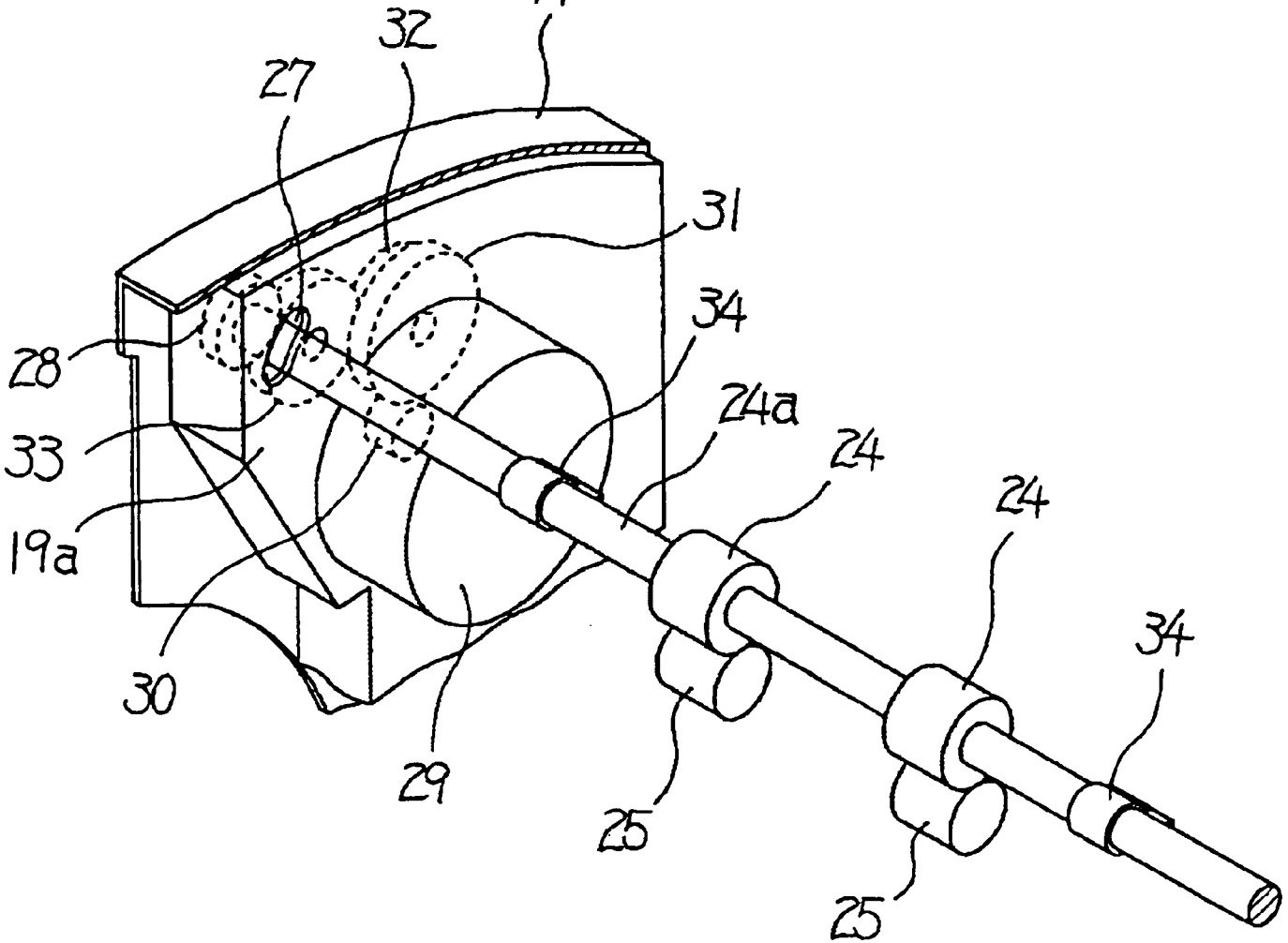
FIG. 6 is a perspective view showing a relation between driver rollers, driven rollers, a roller shaft and a positioning section included in the illustrative embodiment in the closed position of the front cover.
Figure 7:
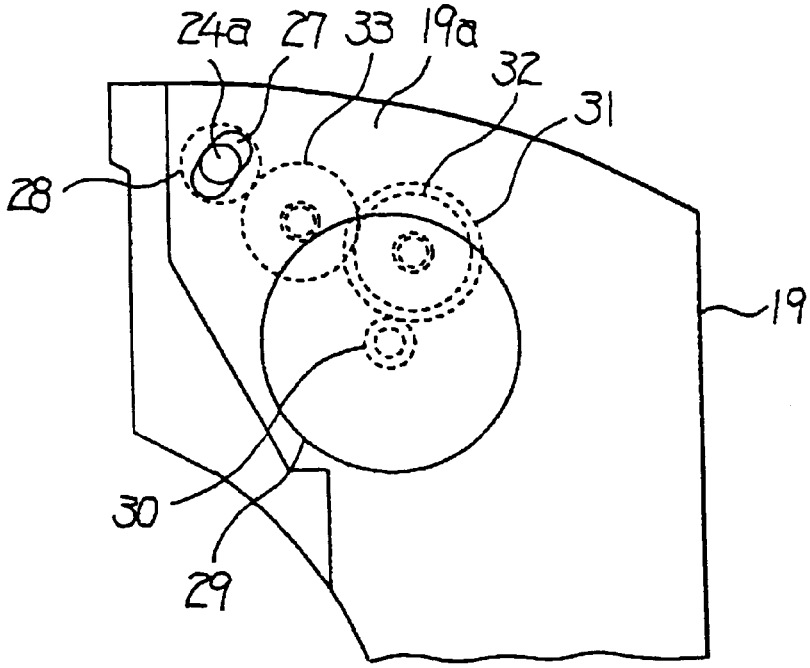
FIG. 7 is a side elevation showing a positional relation between a slot formed in the front cover of the illustrative embodiment, the roller shaft and a first and a second drive gear.

As shown in FIG. 6, the drive roller 24 is representative of a plurality of drive rollers 24 mounted on a roller shaft 24*a*. An arcuate slot 27 is formed in the side wall 19*a*. An arcuate slot identical in configuration with the arcuate slot 27 is formed in the other side wall 19*b* also, although not shown specifically. Opposite ends of the roller shaft 24*a* are received in the arcuate slots 27 such that the roller shaft 24*a* is rotatable about its own axis and freely movable in the lengthwise direction of the slots 27. The arcuate slots 27 extend in such a direction that when the front cover 19 is moved toward the closed position, the roller shaft 24*a* moves in the slots 27 to vary the amount of eccentricity between its portions received in the slots 27 and its portion supported by a drive roller positioning section, which will be described later.

A first drive gear 28 is mounted on one end of the roller shaft 24*a* and rotatable integrally with the roller shaft 24*a*. A drive motor or drive source 29 and a plurality of gears 30, 31, 32 and 33 for transmitting the output torque of the drive motor 29 to the first gear 28 are mounted on one side wall 19*a* of the front cover 19. The gear 33, held in mesh with the first drive gear 28, will be referred to as a second driver gear hereinafter.

The arcuate slot 27, formed in one side wall 19*a* and supporting one end of the roller shaft 24*a*, has a center coincident with the axis of the second drive gear 33. This is also true with the arcuate slot 27 formed in the other side wall 19*b*, although not shown specifically. When the roller shaft 24*a* moves along the arcuate slot 27 of the side wall 19*a*, the pitch circle of the first drive gear 28 moves on the pitch circle of the second drive gear 33 while touching it externally.

A pair of positioning members 34 are mounted on the casing 2 for positioning the drive rollers 24 and implemented by leaf springs or resilient members. When the front cover 19 is moved about the shaft 18 to the closed position, the roller shaft 24*a* resiliently fits into the positioning members 34 and is supported thereby. More specifically, the positioning members 34 each are generally R-shaped and open at the side where it admits the roller shaft 24*a* thereinto when the front cover 19 is closed. The drive rollers 24 are positioned relative to the driven rollers 25 when the roller shaft 24*a* fits into the positioning members 34.

Figure 5:
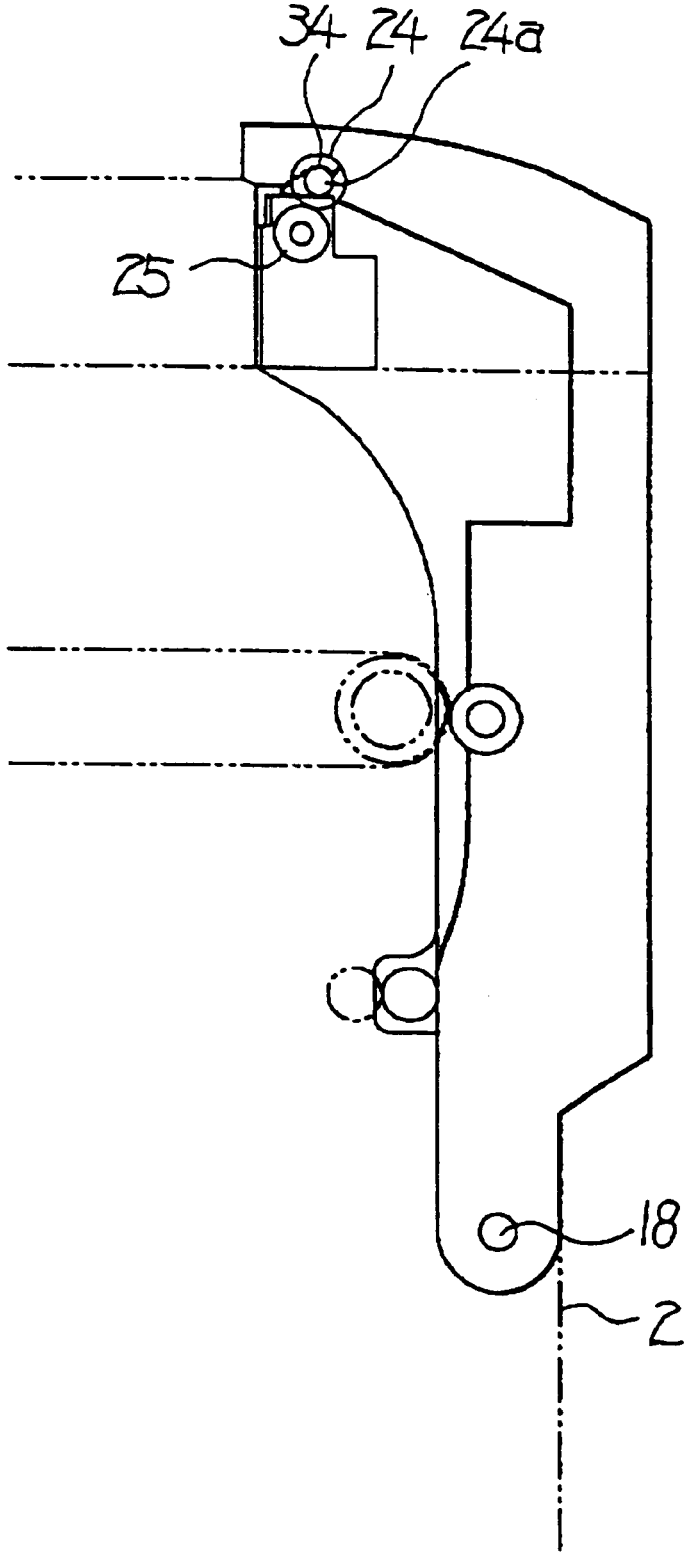
FIG. 5 is a side elevation showing a condition in which the front cover of the illustrative embodiment is held in a closed position.

In the above configuration, when the front cover 19 is moved to the closed position indicated by the solid line in FIG. 3 or 5, the roller shaft 24*a* is resiliently fitted into the positioning members 34, as shown in FIG. 5 or 6. As a result, the drive rollers 24 mounted on the roller shaft 24*a* are positioned in pressing contact with the driven rollers 25.

In operation, a print switch, not shown, mounted on the color printer 1 is pressed after the front cover 19 has been angularly moved to the closed position. In response, the image forming sections 3 start forming respective images. At the same time, a sheet is paid out from the sheet cassette 16 and conveyed along the sheet path 23. A color toner image formed on the belt 5 is transferred to the sheet at the image transferring section 20 and then fixed on the sheet by the fixing section 21. The sheet with the toner image thus fixed is driven out to the print tray 22 by the outlet roller pair 26.

Assume that some dimensional error exists in the front cover 19 supporting the drive rollers 24, e.g., in the distance between the shaft 18 and the drive rollers 24 or in the position of the arcuate slots 27 supporting the roller shaft 24*a*. If the front cover 19 is moved to the closed position in such a condition, the positions where the roller shaft 24*a* is supported in the slots 27 and the positioning members 34 fail to align with each other, resulting in eccentricity. The illustrative embodiment copes with such eccentricity with the following unique operation.

Just after the roller shaft 24*a* mounted on the front cover 19 has been fitted into the positioning members 34 mounted on the casing 2, the roller shaft 24*a* automatically moves in the arcuate slots 27 in a direction in which the eccentricity decreases. As a result, eccentricity between the positions where the roller shaft 24*a* is supported by the slots 27 and the positions where it is supported by the positioning members 34 decreases, so that the bend of the roller shaft 24*a* between the above positions decreases.

With the above configuration, the illustrative embodiment scarcely causes the roller shaft 24*a* to rotate in a bent position even if the dimensional accuracy of the front cover 19, supporting the drive rollers 24, is not increased. This insures stable rotation of the drive rollers 24 and driven rollers 25 and therefore accurate conveyance of a sheet while enhancing durability of the rollers 24 and 25 and roller shaft 24*a*.

In the illustrative embodiment, the center of each arcuate slot 27 is coincident with the axis of the second drive gear 33, as stated earlier. Therefore, the roller shaft 24*a* moves in the slots 27 such that the pitch circle of the first drive gear 28 moves on the pitch circle of the second drive gear 33 while touching it externally. It follows that the first gear 28 and second gear 33 remain in mesh with each other in a constant condition, accurately transferring the output torque of the drive motor 29 to the drive rollers 24.

Figure 8:
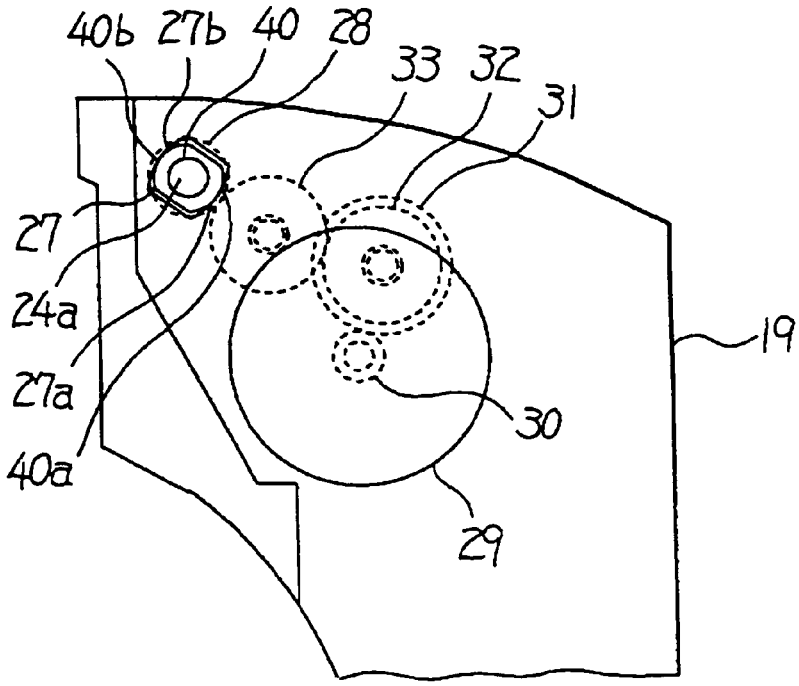
FIG. 8 is a side elevation showing an alternative embodiment of the present invention.

Reference will be made to FIG. 8 for describing an alternative embodiment of the present invention. In FIG. 8, parts and elements identical with the parts and elements shown in FIGS. 3 through 7 are designated by identical reference numerals, and a detailed description thereof will not be made in order to avoid redundancy. As shown, the arcuate slots 27, each having a center coincident with the axis of the second drive gear 32, are formed in the side walls 19*a* and 19*b* of the front cover 19 as in the previous embodiment.

In the illustrative embodiment, a bearing 40 is fitted in each of the arcuate slots 27 while the roller shaft 24*a* is rotatably supported by the bearing 40. The bearing 40, having an elliptical shape, includes an inner contact surface 40*a* and an outer contact surface 40*b* held in slidable, point-to-point contact with an inner arcuate surface 27*a* and an outer arcuate surface 27*b*, respectively, included in the slot 27. The outside diameter of the bearing 40 is selected such that the bearing 40 is prevented from rotating by more than 360° in the slot 27.

In operation, when the front cover 19 is moved about the shaft 18 to the closed position indicated by the solid line in FIG. 3 or 5, the roller shaft 24*a* is fitted into the positioning members 33, as shown in FIG. 5 or 6. As a result, the drive rollers 24 are brought into pressing contact with the driven rollers 25.

Assume that a dimensional error exists in, e.g., the front cover 19 or the position of the second drive bear 32 mounted on the side wall 19*a*. Then, when the front cover 19 is moved to the closed position, the positions where the bearings 40 are supported in the arcuate slots 27 and the positioning members 33, see FIGS. 6 through 8, fail to align with each other, again resulting in eccentricity. The illustrative embodiment copes with such eccentricity with the following unique operation.

Just after the roller shaft 24*a* mounted on the front cover 19 has been received in the positioning members 34 mounted on the casing 2, the bearings 40 automatically moves in the arcuate slots 27 in a direction in which the eccentricity decreases. As a result, eccentricity between the positions where the bearings 40 are supported by the slots 27 and the positions where the roller shaft 24*a* is supported by the positioning members 34 decreases, so that the bend of the roller shaft 24*a* between the above positions decreases.

With the above configuration, the illustrative embodiment scarcely causes the roller shaft 24*a* to rotate in a bent position even if the dimensional accuracy of the front cover 19, supporting the drive rollers 24, is not increased. This insures stable rotation of the drive rollers 24 and driven rollers 25 and therefore accurate conveyance of a sheet while enhancing durability of the rollers 24 and 25 and roller shaft 24*a*.

Again, the center of each arcuate slot 27 is coincident with the axis of the second drive gear 33. Therefore, the bearings 40 move in the slots 27 together with the roller shaft 24*a* such that the pitch circle of the first drive gear 28 moves on the pitch circle of the second drive gear 33 while touching it externally. It follows that the first gear 28 and second gear 33 remain in mesh with each other in a constant condition, accurately transferring the output torque of the drive motor 29 to the drive rollers 24.

Further, the roller shaft 24*a* is rotatably supported by the bearings 40, which are movable in the arcuate slots 27, and can therefore stably rotate without wearing. In addition, the bearings 40 can smoothly move in the slots 27 because the inner contact surfaces 40*a* and outer contact surfaces 40*b* of the former are respectively held in point-to-point contact with the inner arcuate surfaces 27*a* and outer arcuate surfaces 27*b* of the latter.

In summary, it will be seen that the present invention provides a sheet conveying device capable of scarcely causing a roller shaft to rotate in a bent position even if the dimensional accuracy of a front cover, supporting drive rollers, is not increased. This insures stable rotation of the drive rollers and driven rollers and therefore accurate conveyance of a sheet while enhancing durability of the rollers and roller shaft. Further, the output torque of a drive source can be accurately transferred to the drive rollers. In addition, the device of the present invention has an extremely simple configuration.

What is claimed is:

1. A sheet conveying device for an image forming apparatus, comprising:

a driven roller mounted on a casing of the image forming apparatus and rotatable about an axis thereof;

a cover positioned on a perimeter of the image forming apparatus and supporting a roller shaft on which a drive roller is mounted in such a manner as to be rotatable about an axis of said drive roller, said cover being hinged to the casing to be angularly movable between a closed position where a circumferential surface of said drive roller is pressed against a circumferential surface of said driven roller and an open position where said circumferential surface of said drive roller is released from said circumferential surface of said driven roller;

a positioning section including a positioning member included in the casing and configured to support, when said cover is moved to the closed position, said roller shaft by removably receiving the roller shaft in the positioning member to thereby position said roller shaft;

a first drive gear affixed to an end of said roller shaft and rotatable integrally with said roller shaft; and a second drive gear mounted on the cover and held in mesh with said first drive gear and configured to receive a drive force from a drive source, wherein said roller shaft is supported by said cover such that a pitch circle of said first drive gear moves on a pitch circle of said second drive gear while touching said pitch circle of said second drive gear externally.

2. A sheet conveying device for an image forming apparatus, comprising:

a driven roller mounted on a casing of the image forming apparatus and rotatable about an axis thereof;

a cover supporting a roller shaft on which a drive roller is mounted in such a manner as to be rotatable about an axis of said drive roller, said cover being hinged to the casing to be angularly movable between a closed position where a circumferential surface of said drive roller is pressed against a circumferential surface of said driven roller and an open position where said circumferential surface of said drive roller is released from said circumferential surface of said driven roller;

a positioning section included in the casing and configured to support, when said cover is moved to the closed position, said roller shaft for thereby positioning said roller shaft;

a first drive gear affixed to an end of said roller shaft and rotatable integrally with said roller shaft; and a second drive gear held in mesh with said first drive gear and configured to receive a drive force from a drive source, wherein said roller shaft is supported by said cover such that a pitch circle of said first drive gear moves on a pitch circle of said second drive gear while touching said pitch circle of said second drive gear externally, and an arcuate slot, having a center coincident with an axis of said second drive gear is formed in said cover, said roller shaft being supported in said arcuate slot in such a manner as to be rotatable in a lengthwise direction of said arcuate slot.

3. The device as claimed in claim 2, wherein said slot extends in a direction in which when said cover is being moved toward the closed position, said roller shaft moves in said slot to thereby vary an amount of eccentricity between a portion of said roller shaft positioned in said slot and a portion of said roller shaft supported by said positioning section.

4. The device as claimed in claim 2, wherein said positioning section included in said casing includes at least one positioning member configured to receive said roller shaft therein when said roller shaft is in said closed position.

5. A sheet conveying device for an image forming apparatus, comprising:

a driven roller mounted on a casing of the image forming apparatus and rotatable about an axis thereof;

a cover supporting a roller shaft on which a drive roller is mounted in such a manner as to be rotatable about an axis of said drive roller, said cover being hinged to the casing to be angularly movable between a closed position where a circumferential surface of said drive roller is pressed against a circumferential surface of said driven roller and an open position where said circumferential surface of said drive roller is released from said circumferential surface of said driven roller;

a positioning section included in the casing and configured to support, when said cover is moved to the closed position, said roller shaft for thereby positioning said roller shaft;

a first drive gear affixed to an end of said roller shaft and rotatable integrally with said roller shaft; and a second drive gear held in mesh with said first drive gear and configured to receive a drive force from a drive source, wherein said roller shaft is supported by said cover such that a pitch circle of said first drive gear moves on a pitch circle of said second drive gear while touching said pitch circle of said second drive gear externally, and an arcuate slot, having a center coincident with an axis of said second drive gear, is formed in said cover while a bearing is received in said arcuate slot in such a manner as to be movable in a lengthwise direction of said arcuate slot, said roller shaft being rotatably supported by said bearing.

6. The device as claimed in claim 5, wherein said slot extends in a direction in which when said cover is being moved toward the closed position, said bearing moves in said slot to thereby vary an amount of eccentricity between a portion of said roller shaft supported by said bearing and a portion of said roller shaft supported by said positioning section.

7. The device as claimed in claim 5, wherein said bearing includes an inner contact surface and an outer contact surface respectively held in contact with an inner arcuate surface and an outer arcuate surface of said slot.

8. The device as claimed in claim 7, wherein said inner contact surface and said outer contact surface are held in point-to-point contact with said inner arcuate surface and said outer arcuate surface, respectively.

9. The device as claimed in claim 5, wherein an outside diameter of said bearing is selected such that said bearing is prevented from rotating by more than 360° in said slot.

10. The device as claimed in claim 5, wherein said positioning section included in said casing includes at least one positioning member configured to receive said roller shaft therein when said roller shaft is in said closed position.

11. A sheet conveying device for an image forming apparatus, comprising:

a driven roller mounted on a casing of the image forming apparatus and rotatable about an axis thereof;

a cover supporting a roller shaft on which a drive roller is mounted in such a manner as to be rotatable about an axis of said drive roller, said cover being hinged to the casing to be angularly movable between a closed position where a circumferential surface of said drive roller is pressed against a circumferential surface of said driven roller and an open position where said circumferential surface of said drive roller is released from said circumferential surface of said driven roller;

a positioning section including a positioning member included in the casing and configured to support, when said cover is moved to the closed position, said roller shaft by removably receiving the roller shaft in the positioning member to thereby position said roller shaft;

a first drive gear affixed to an end of said roller shaft and rotatable integrally with said roller shaft; and a second drive gear held in mesh with said first drive gear and configured to receive a drive force from a drive source, wherein said roller shaft is supported by said cover such that a pitch circle of said first drive gear moves on a pitch circle of said second drive gear while touching said pitch circle of said second drive gear externally, and said drive source is mounted on said cover.

12. An image forming apparatus, comprising:

a sheet conveying device; and an image forming section configured to form an image to be transferred to a sheet being conveyed by said sheet conveying device;

said sheet conveying device comprising:

a driven roller mounted on a casing of the image forming apparatus and rotatable about an axis thereof;

a cover positioned on a perimeter of the image forming apparatus and supporting a roller shaft on which a drive roller is mounted in such a manner as to be rotatable about an axis of said drive roller, said cover being hinged to the casing to be angularly movable between a closed position where said drive roller is pressed against a surface of said driven roller and an open position where aid drive roller is released from said driven roller;

a positioning section including a positioning member included in the casing and configured to support, when said cover is moved to the closed position, said roller shaft by removably receiving the roller shaft in the positioning member to thereby position said roller shaft;

a first drive gear affixed to an end of said roller shaft and rotatable integrally with said roller shaft; and a second gear mounted on the cover and held in mesh with said first drive gear and configured to receive a drive force from a drive source, wherein said roller shaft is supported by said cover such that a pitch circle of said first drive gear moves on a pitch circle of said second drive gear while touching said pitch circle of said second drive gear externally.

* * * * *